US011628120B1

(12) United States Patent
Piccirillo

(10) Patent No.: US 11,628,120 B1
(45) Date of Patent: Apr. 18, 2023

(54) BABY SOOTHING DEVICES

(71) Applicant: Baby Soothe Inc., Staten Island, NY (US)

(72) Inventor: Lauren Piccirillo, Staten Island, NY (US)

(73) Assignee: Baby Soothe Inc., Staten Island, NY (US)

( * ) Notice: Subject to any disclaimer, the term of this patent is extended or adjusted under 35 U.S.C. 154(b) by 376 days.

(21) Appl. No.: 15/918,639

(22) Filed: Mar. 12, 2018

Related U.S. Application Data

(63) Continuation of application No. 15/833,221, filed on Dec. 6, 2017, now abandoned, which is a continuation of application No. 15/688,123, filed on Aug. 28, 2017, now abandoned, which is a continuation of application No. 15/597,499, filed on May 17, 2017, now abandoned, which is a continuation of application No. 14/446,787, filed on Jul. 30, 2014, now abandoned.

(60) Provisional application No. 61/860,472, filed on Jul. 31, 2013.

(51) Int. Cl.
*A61H 23/00* (2006.01)
*A61H 23/02* (2006.01)
*A61H 7/00* (2006.01)

(52) U.S. Cl.
CPC ..... *A61H 23/02* (2013.01); *A61H 7/004* (2013.01); *A61H 2007/009* (2013.01); *A61H 2201/0134* (2013.01); *A61H 2201/1215* (2013.01); *A61H 2201/1671* (2013.01); *A61H 2201/5048* (2013.01); *A61H 2201/5058* (2013.01); *A61H 2203/0443* (2013.01)

(58) Field of Classification Search
CPC ..... A61H 23/02; A61H 7/004; A61H 2201/5058; A61H 2201/1215; A61H 2201/5048; A61H 2201/1671; A61H 2203/0443; A61H 2007/009; A61H 2201/0134; A61H 2201/12; A61H 2201/1207; A61H 2201/1463; A61H 2201/1472
USPC ..... D24/211–215
See application file for complete search history.

(56) References Cited

U.S. PATENT DOCUMENTS 1,720,471 A * 7/1929 Rockel ..... B43K 25/022 24/11 S
2,306,424 A * 12/1942 Betz ..... A61H 15/0085 601/119
4,526,163 A * 7/1985 Fedders ..... A61H 7/004 601/112
5,063,912 A * 11/1991 Hughes ..... A47D 15/001 446/295
6,142,963 A * 11/2000 Black ..... A61H 23/0254 601/57
D643,540 S * 8/2011 Jian ..... D24/211
D789,548 S * 6/2017 Cheng ..... D24/211
2005/0124921 A1* 6/2005 Tseng ..... A61H 7/007 601/86

(Continued)

*Primary Examiner* — Quang D Thanh
(74) *Attorney, Agent, or Firm* — Ward Law Office LLC; Jacob M. Ward

(57) ABSTRACT

Devices for soothing a baby may simulate the feel of massage by a caregiver with a circular massaging motion. An apparel component, such as a swaddle blanket or sleep sack, may be configured to receive the device. At least one clip may facilitate placement of the device.

9 Claims, 12 Drawing Sheets

(56) References Cited

U.S. PATENT DOCUMENTS

| | | | | |
|---|---|---|---|---|
| 2010/0030122 | A1* | 2/2010 | Gaspard | A61H 7/004<br>601/136 |
| 2011/0196274 | A1* | 8/2011 | Ding | A61H 7/007<br>601/136 |
| 2015/0157078 | A1* | 6/2015 | Kendis | A45F 5/02<br>24/3.12 |

* cited by examiner

BABY SOOTHING DEVICES

CROSS-REFERENCE TO RELATED APPLICATION

This application is a continuation of U.S. Non-Provisional patent application Ser. No. 15/833,221 filed on Dec. 6, 2017 and on Sep. 12, 2018, which is a continuation of U.S. Non-Provisional patent application Ser. No. 15/688,123 filed on Aug. 28, 2017 and on Feb. 11, 2019, which is a continuation of U.S. Non-Provisional patent application Ser. No. 15/597,499 filed on May 17, 2017 and on Mar. 15, 2018, which is a continuation of U.S. Non-Provisional patent application Ser. No. 14/446,787 filed on Jul. 30, 2014 and on Sep. 28, 2017, which claims the benefit of priority to U.S. Provisional Patent Application Ser. No. 61/860,472 filed Jul. 31, 2013, the entire disclosures which are hereby incorporated herein by reference in their entirety for all purposes.

APPLICABLE FIELD

One or more aspects relate generally to techniques for soothing babies and, more particularly, to devices which can simulate a mother's touch by emulating a massaging motion.

BACKGROUND

Baby colic (also known as infantile colic) is a condition in which an otherwise healthy baby cries frequently and for extended periods for no discernible reason. Symptoms of colic typically occur during the first months of life, but can often last for as long as one year. Persistent infant crying may not only be exhausting for parents but may also result in the child developing serious medical problems. Babies may also experience general separation anxiety, and may otherwise benefit from soothing such as to fall asleep. Pain from teething or illness may also plague children.

SUMMARY

In accordance with one or more aspects, devices may generally simulate a mother's soothing touch by mimicking a mother's substantially circular massaging motion to help babies fall asleep, address separation anxiety, and ease colic symptoms. Children who are teething or sick may also be soothed.

While it is not entirely clear what causes baby colic, some medical professionals have suggested that rhythmic motions by a caregiver can soothe the baby. For example, rhythmic motion can include circular, unidirectional, or bidirectional rubbing of the baby's stomach or back. Providing rhythmic motion to a baby may only temporarily relieve the colic while the child is being held. However, holding the child for a prolonged period of time may be tiring and uncomfortable for the caregiver. Beneficially, devices in accordance with one or more aspects described herein may provide soothing and rhythmic motion to a baby independent of a caregiver. Such devices are infant safe meeting all applicable safety standards and requirements, proportionally sized, portable, and accurately simulate the feel of motion by a human caregiver. In at least some aspects, the devices are easy to use, self contained and do not require mounting hardware. In other aspects, the devices may be wearable for hands-free operation. In various aspects, the devices may sooth a baby via massage in place of or in conjunction with vibration. Caregivers may in turn be relaxed facilitating a tranquil environment.

According to some non-limiting aspects, the baby soothing device generally includes a housing and one or more rotating members protruding from the housing. In various embodiments, the members are configured to move in a circular rhythmic pattern to provide a massage to the baby and help to relieve distress and anxiety. In some embodiments, a mother's clockwise or counterclockwise circular massaging motion may be mimicked or emulated.

The rotating members may be comprised of flexible material that allows them to collapse, bend in or tuck into the housing of the baby soothing device. By collapsing inside the housing, the rotating members do not act as protruding hindrances and are not bothersome to the baby. In other embodiments, the rotating members may be fixed in place and not collapse. The device may include one or more clips to facilitate placement.

Multiple embodiments of the baby soothing device are disclosed herein, including rectangular and triangular shaped housings which include openings for one or more rotating members. It is appreciated that any number of combinations of rotating members may be disposed in the baby soothing device. In addition, multiple embodiments of the rotating members are disclosed including half circle shaped rotating members, u-shaped rotating members, and finger shaped rotating members.

Still other aspects, embodiments, and advantages of these exemplary aspects and embodiments, are discussed in detail below. Any embodiment disclosed herein may be combined with any other embodiment in any manner consistent with at least one of the objects, aims, and needs disclosed herein, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. The appearances of such terms herein are not necessarily all referring to the same embodiment. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

Various aspects of at least one embodiment are discussed below with reference to the accompanying figures, which are not intended to be drawn to scale. Where technical features in the figures, detailed description or any claim are followed by references signs, the reference signs have been included for the sole purpose of increasing the intelligibility of the figures, detailed description, and claims. Accordingly, neither the reference signs nor their absence are intended to have any limiting effect on the scope of any claim elements. For purposes of clarity, not every component may be labeled in every figure. The figures are provided for the purposes of illustration and explanation and are not intended as a definition of the limits of the invention. In the figures:

DETAILED DESCRIPTION

Figure 1:
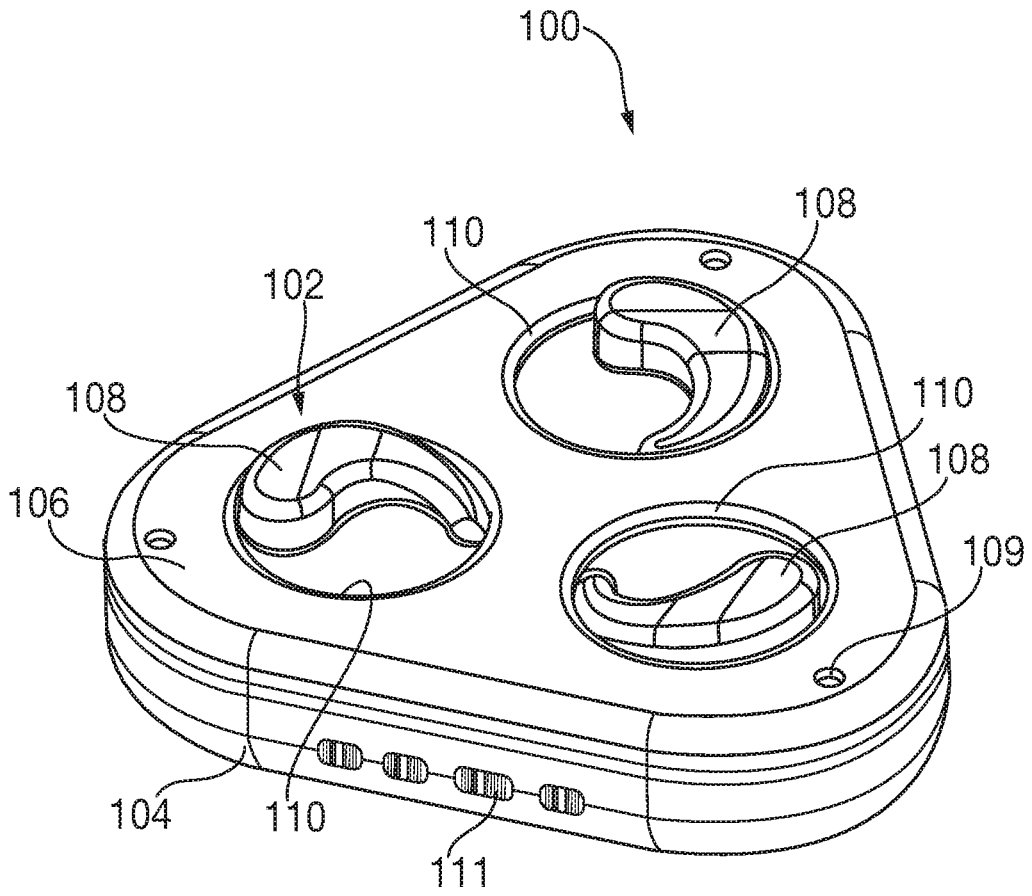
FIG. 1 is an isometric view of one example of a baby soothing device, according to one embodiment.

In accordance with one or more embodiments, devices may simulate a mother's soothing touch through rhythmic motion such as with a circular massaging motion. The devices may sooth babies to sleep easily and effortlessly. The devices may calm separation anxiety and baby colic symptoms may also be reduced. Ill or teething babies may also be soothed. Babies may be relaxed without a caregiver's direct touch. The devices may generally employ massaging techniques, alone or in conjunction with vibration.

One or more non-limiting embodiments are directed to a baby soothing device that includes one or more rotating elements protruding from a housing that are driven by a motor assembly. When applied to a baby's back, chest or abdomen, each of the rotating members rotate in a circular rotational pattern. The pattern of rotation of rotating elements applies a calming motion that is both comforting and safe for the child. The sensation may be one of massaging such as by a caregiver. The size and shape of the elements reduces the amount of force applied to the child and the construction of the elements provides a level of safety if the child rolls over onto the device.

In one embodiment, the baby soothing device can be embedded in an insert with a top surface of the device exposed in the insert or protruding from the insert. The insert can be placed within a blanket, such as for example a child swaddling blanket or sleep sack. The child can be wrapped inside the blanket with the device to provide continuous massage to the baby. The insert provides an added level of comfort to the child, as most of the contact with the child is through the soft insert rather than hard plastic of the device housing. The insert is portable and can be placed in almost any child carrying device, such as baby car seat, stroller, crib, bassinet, or bjorn.

It is to be appreciated that embodiments of the devices and methods discussed herein are not limited in application to the details of construction and the arrangement of components set forth in the following description or illustrated in the accompanying drawings. The invention is capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiments.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, and vertical and horizontal are intended for convenience of description, not to limit the present systems and methods or their components to any one positional or spatial orientation.

In reference to FIG. 1, there is illustrated one example of a baby soothing device 100, orientated in a top isometric view. In the illustrated example, the baby soothing device includes a housing 102 having a top portion 104 and bottom portion 106 and rotating elements 108, as further described below. The bottom portion 106 includes apertures 110 through which the rotating elements 108 protrude from the inside of the housing 102. In use, the bottom portion is placed on the body of the baby, with the rotating elements touching the baby. In one embodiment, the baby soothing device 100 is configured to rest lightly on top of the infant, while the baby is laying on the back or the stomach, and the timed rotating motion of the rotating elements 108 acts to relieve distress and anxiety of the baby. The rotation may be substantially circular, such as clockwise or counterclockwise to simulate a mother's massaging motion.

In accordance with one or more embodiments, the device can be inserted into a garment or blanket. In some embodiments, clothing or a blanket may include a custom pocket strategically positioned, for example, on its front (belly) or back that is configured to receive the device. In some embodiments, the pocket may be padded.

The bottom 106 and top portions 104 of the housing 102 fit together to enclose electrical and mechanical components of the baby soothing device 100. In the illustrated example, the bottom portion 106 comprises a plate substantially extending the length and width of the baby soothing device 100. In one example, the edges of the top portion 104 are rounded to create a volume between the top and the bottom portion for a number of components to be placed within the housing 102. The height of the housing 102 allows sufficient space for the components to be placed inside, while retaining a low profile that would enable the baby soothing device to be placed in a soft insert, as described further below. In one example, the plate comprising the bottom portion includes a substantially straight surface and further includes connection points that allow the bottom portion to be connected to the bottom portion 104. In another example, the top and bottom portions can be substantially equal in height and the volume created by the rounded edges and can be jointed at a seam forming a circumference around the device (shown in FIGS. 6A and 6B).

Figure 6A:
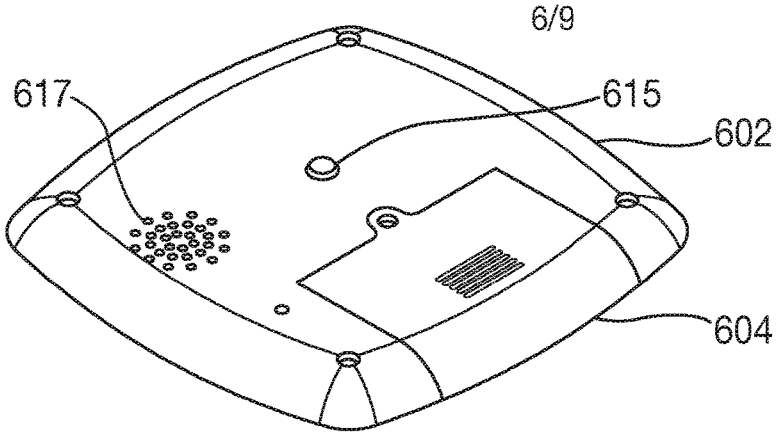
FIG. 6A is an isometric view of one example of a top housing of a baby soothing device, according to another embodiment.
Figure 6B:
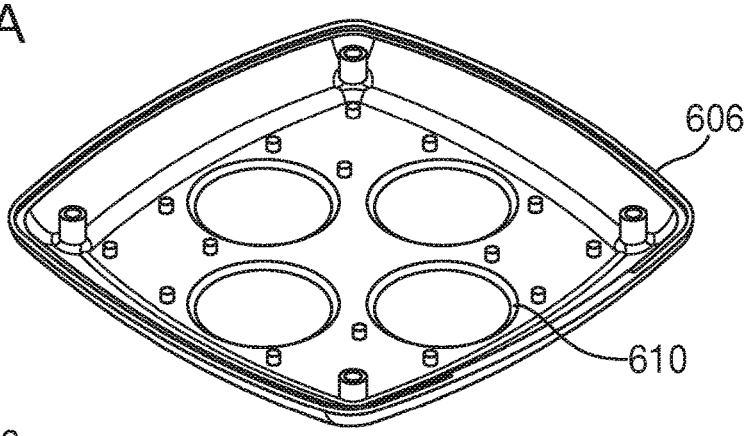
FIG. 6B is an isometric view of one example of a bottom housing of the baby soothing device, according to another embodiment.
Figure 6C:
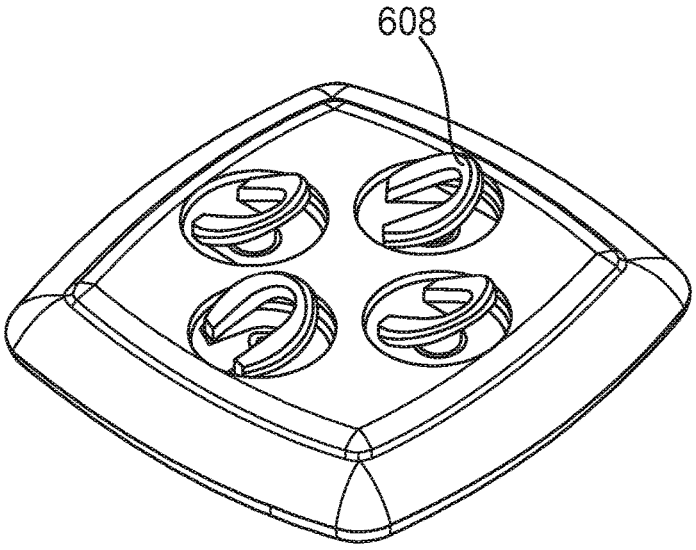
FIG. 6C is an isometric view of one example of the baby soothing device with rotating elements, according to another embodiment.

The baby soothing device as illustrated in one example of FIG. 1 is triangular in shape having three acute angles. In one example, the housing 102 is an equilateral triangle. In other examples, triangles of other shapes are contemplated. The triangular-shaped housing 102, in one example, includes rounded corners. In one implementation, both the top and the bottom portions of the housing may include multiple parts comprising the top and bottom portions. For example, the bottom portion may include straight side portions for the sides of the bottom portion of the housing, and rounded portions disposed therebetween. The rounded portion may connect the straight sides to make up the triangular shape of the top portion of the housing 102. In other examples, the housing may include other shapes, such as circular, square, rectangular, hexagonal, or trapezoidal. One example of a rectangular-shaped housing is shown in FIG. 6A-6C.

Figure 2:
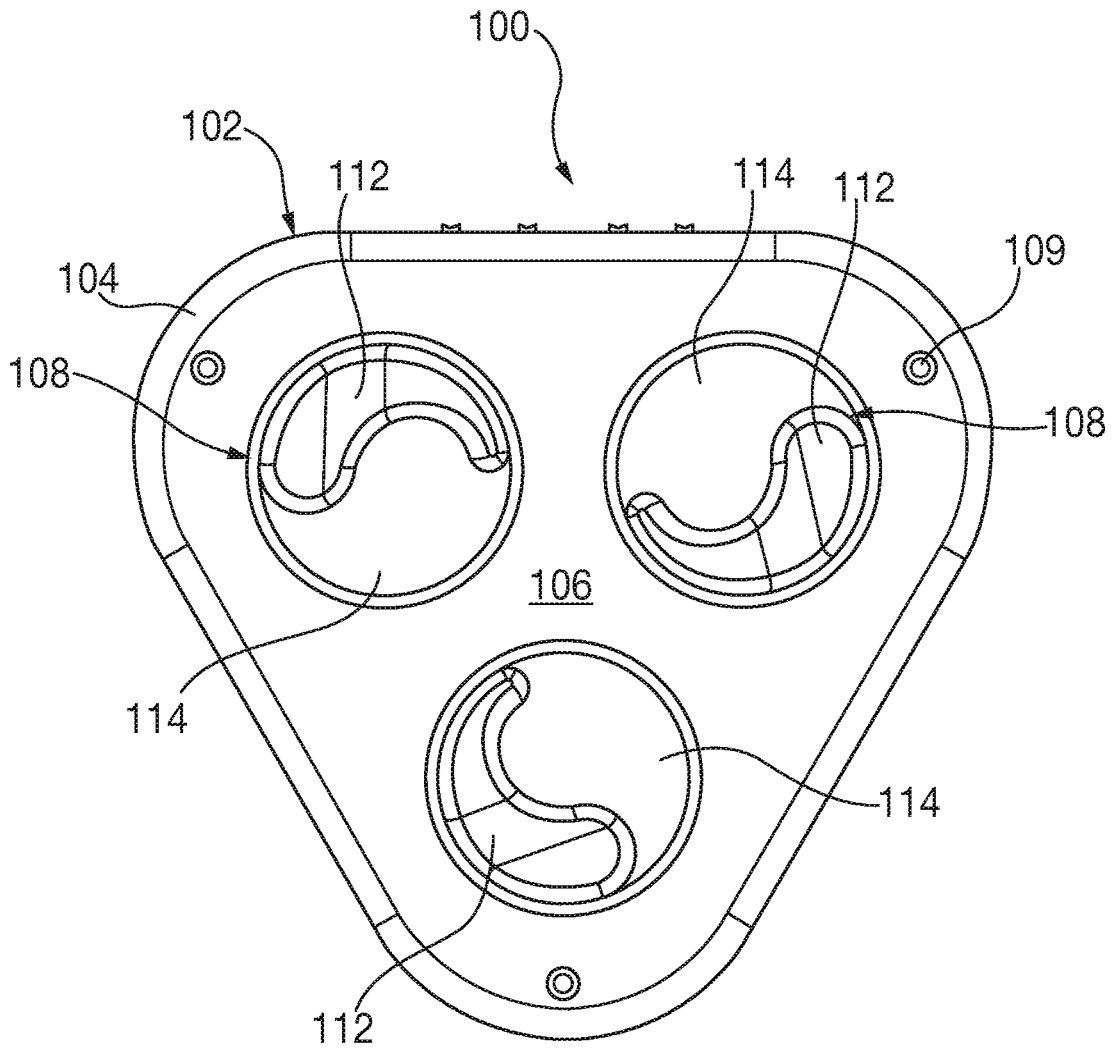
FIG. 2 is a top view of one example of the baby soothing device, according to one embodiment.

FIG. 2 shows a bottom view illustrating the bottom portion of the baby soothing device including apertures 110 through which the rotating elements 108 protrude. In one embodiment, the bottom portion 106 includes three apertures through which three massaging portions 112 of the rotating elements 108 protrude from the inside of the housing 102. As described above, the bottom portion 106 comprises a plate that extends to the perimeter of the top portion 104 of the housing 102. In this example, the bottom portion 106 can be secured using connecting elements 109, such as screws, bolts or rivets, inserted into corresponding pegs or holes to secure the bottom portion 106 to the baby soothing device (shown in FIGS. 1 and 4).

Figure 3:
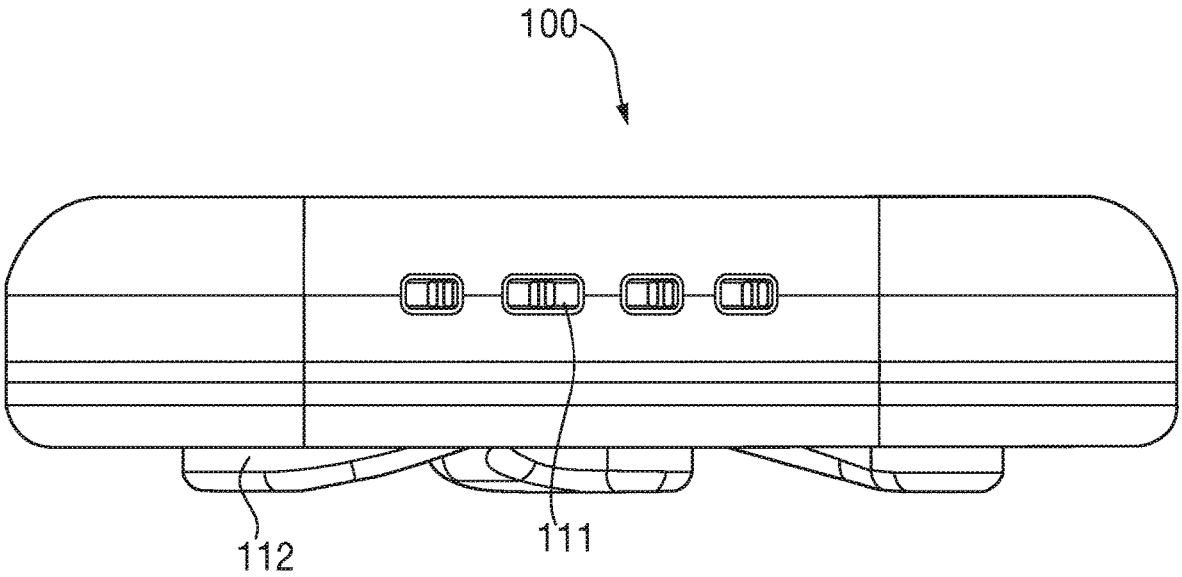
FIG. 3 is a side view of one example of the baby soothing device, according to one embodiment.

As shown, in the example of FIG. 3, the apertures correspond to the corners of the triangular shaped housing, with each aperture 110 corresponding to each corner. The apertures 110 are circular and spaced equally apart from each other with equal space between the apertures. In one example, the apertures 110 are sized to cover a substantial portion of the bottom portion 106 of the housing 102. In other examples, the size, shape, number and placement of apertures 110 may correspond to the different shapes of the rotating elements 108 and the different shapes of the housing 102, given the benefits of this disclosure.

Figure 4:
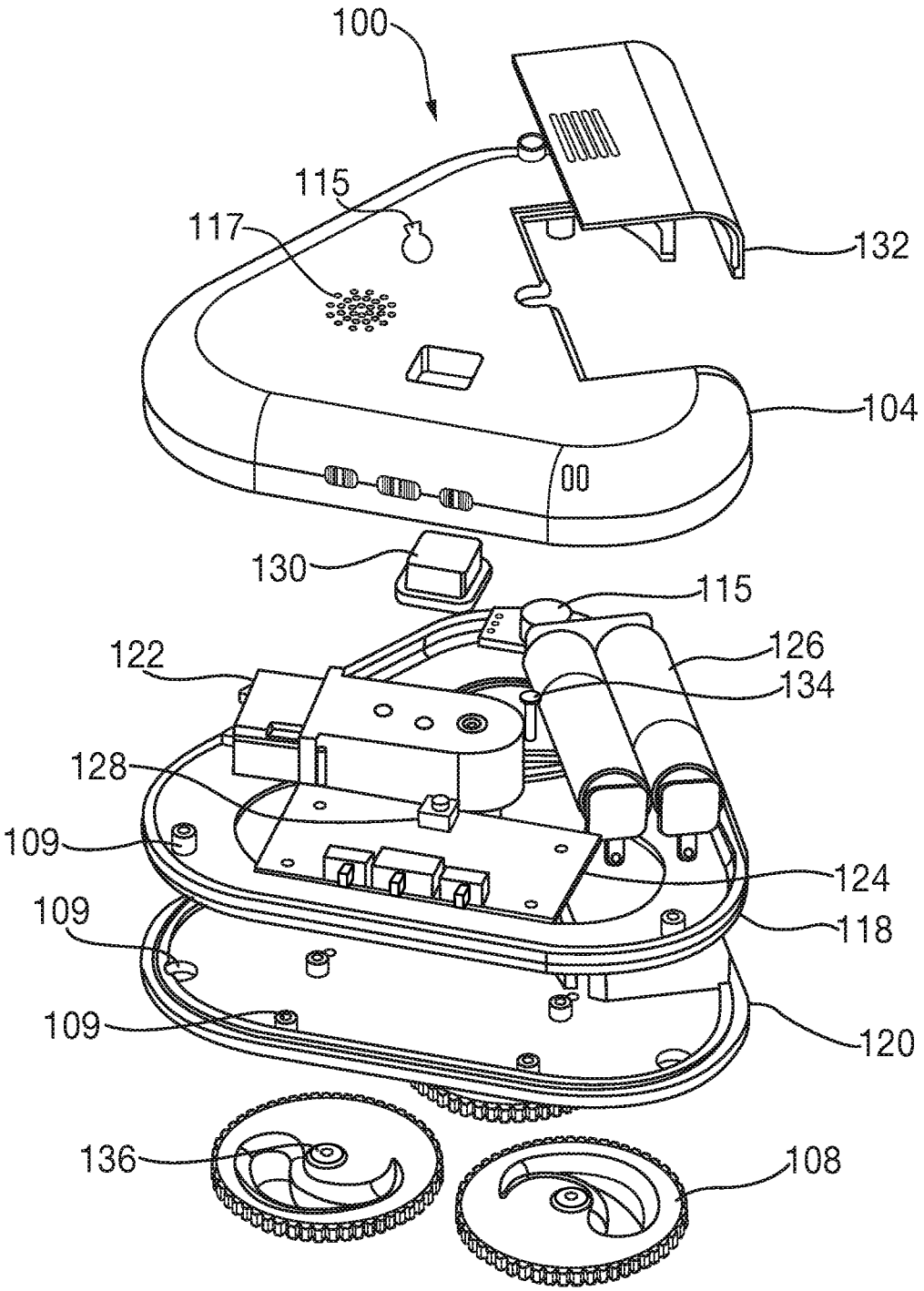
FIG. 4 is an exploded view of one example of the baby soothing device, according to one embodiment.

FIG. 4 illustrates an exploded view of the baby soothing device 100 including the top portion 104 of the housing 102, a top panel 118, a bottom panel 120 and the rotating elements 108. The top panel 118 holds a motor assembly 122 for driving the rotating elements 108, a control panel 124 for controlling the pattern of motion of the rotating elements 108, and a power source 126 for provide power to the baby soothing device 100.

As discussed above, the components attached to the top panel 118, the bottom panel 120 and the rotating elements 108 fit substantially within the bottom portion 106 of the housing 102. The top portion 104 includes an aperture for an activation switch housing 130 (i.e. a start button) that can be connected to an activation switch 128 connected to the control panel which may activate the baby soothing device 100. In one example, the activation switch 128 can also activate a speaker 117 associated with the baby soothing device 100 which may produce recorded sounds or music which may be soothing for the baby.

The top portion 104 of the housing further includes a compartment 132 for access to the power source 126. In one example, the compartment 132 can be located in any portion of the device and can be sized appropriately to the power source 126. The compartment may be removable (for example via the connecting element 134) to reveal the power source 126 and allow a user to remove and replace the power source 126.

The top portion 104 can further include apertures for rotating pattern control switches 111. In one example, the rotating pattern control switches 111 protrude through the bottom portion 104 of the housing to allow a user to activate one or more of the switches 111. The apertures for the switches 111 are shaped and sized to the shape and size of the control switches. The switches 111 protrude enough to be activated by the user, while remaining protected so that the switches are not accidently activated by nearby objects in contact with the baby soothing device. In one example, the switches 111 may provide a control signal to control the duration, strength and pattern of the motion of the rotating elements 108.

Referring to FIG. 4, the top panel 118 comprises a triangular shape similar to that of the housing 102. In one example, the top panel 118 attaches to the top portion 104 of the housing via one or more connection points or pegs disposed on the top panel 118. In order to fit within the housing, the width and length dimensions of the top panel 118 are slightly smaller than the housing 102. To be stably secured within the housing 102, the top panel 118 substantially spans the length and width of the inside of the housing 102. The top panel 118 is also mechanically attached to the bottom panel via one or more connection points 109 located either on the top panel 118 or on the bottom panel. One or more connecting elements 109, such as screws, bolts or rivets hold the panels in place between the connection points 109. The components, such as the power source 126, the motor assembly 122 and control panel 124, disposed on the top panel 118, are mechanically secured to the top panel 118. In at least one example, the top panel 118 may include a number of openings for one or more of the components such as the power source, the motor assembly 122 and control panel 124 to be placed within the openings. The opening may also provide for the components to be secured within the panel and prevent movement of the components within the housing.

The top panel 118, as described above, includes the power source 126 which may be attached to the top panel 118. The power source 126 is electrically coupled to the motor assembly 122 and the control panel 124 and is configured to provide power to both the control panel 124 and the motor assembly 122. In the illustrated example of FIG. 4, the power source 126 comprises a DC battery power source such as Ni—Cd, Ni—H, or Li-ion battery. However, another power source can be used. The power source 126 is large enough to sustain continuous power for the baby soothing device during multiple uses or activations, but light enough to avoid adding pressure to the baby when the device is laying on top of the baby.

The electric motor assembly 122, in one example, may be attached to the top panel 118 and is configured to drive the rotating elements 108 in one or more rotating motions as further described below. The motor assembly 122 may include an electric motor enclosed in a housing. The motor may be a bi-direction, slow speed, rotating motor providing rotating motion to the rotating elements 108.

The top panel 118, in one example, includes the control panel 124 connected to the motor assembly 122 and the power source. The control panel 124 may include an electric circuit board comprising a controller and a memory disposed on the control panel. The control panel 124 may control the motion of the rotating elements 108, the timing and pattern of the motion, the turn on and turn off times associated with the baby soothing device. In one example, the switches may receive input from the user to increase or decrease the speed of the rotating elements 108, the controller may receive the input and translate the input as a control signal to the motor assembly 122 to increase or decrease the speed of the rotating motion. Similarly the controller can translate input to control signals to control the pattern of rotation. In one example, the memory may store one or more patterns of motion. The controller may access the pattern from the memory and provide a corresponding control signal to the motor assembly. The pattern of rotation can simulate the rhythmic motion of a caregiver.

In at least one example, the controller may include a timer feature configured to control the how long the baby soothing device stays turned on. For example, without further input from the user, the controller may be configured to send a control signal to turn the baby soothing device off after a period of time. In some examples, if an input from a user is received the controller may continue to power on the baby soothing device for another period of time. In at least one example, the baby soothing device may include a sensor, for example, a motion or a sound sensor, configured to sense movement or sound from the baby. The sensor may be electrically coupled to the controller and disposed on the outside of the housing. For example, if no motion or no sound is detected, the controller may be configured to send a control signal to power down the baby soothing device. However, if motion or sound is detected, the controller may be configured to power on the baby soothing device for another period of time.

As discussed above, the controller, in one example, is configured to control the speed and pattern of motion of the rotating elements 108. The control panel 124, in at least one example, includes the control switches 111 which protrude through the control apertures on the bottom portion 104 of the housing. In some examples, the control switches 111 can provide selections to increase or decrease the speed of rotation of the rotating elements 108. The switches can include any type of activation mechanism, such as a button, slider, or a switch. In other examples, the control switches can provide selections to control the pattern of motion of the rotating elements 108. The user may select one or more of the switches to control the rotating elements 108.

In at least one example, the pattern of motion can include rotating in the clockwise or counterclockwise direction. The rotation can include a full (e.g. 360 degree) rotation or a partial (e.g. angles less than 360 degrees) rotation. The pattern of motion can also include periodic pauses between full rotating motions for any suitable or programmable duration. In one example, the pauses between partial or full rotations can simulate rhythmic motions that can be provided by a caregiver. The pattern of motion can also include partial or complete rotation of the rotation elements, and then turning of the rotating elements 108 in the opposite direction. Other patterns of motion or angles of motion can be provided by the control panel 124 and the rotating elements 108 given the benefits of this disclosure.

Referring again to FIG. 4, the top panel 118 is connected to the bottom panel, which provides an attachment point for the rotating elements 108. In one example, the bottom panel provides stability for the rotating elements 108 and serves to separate the rotating elements 108 from the components of the top panel 118. The bottom panel attaches to the top panel 118 via one or more connection points disposed on the bottom panel.

Figure 5:
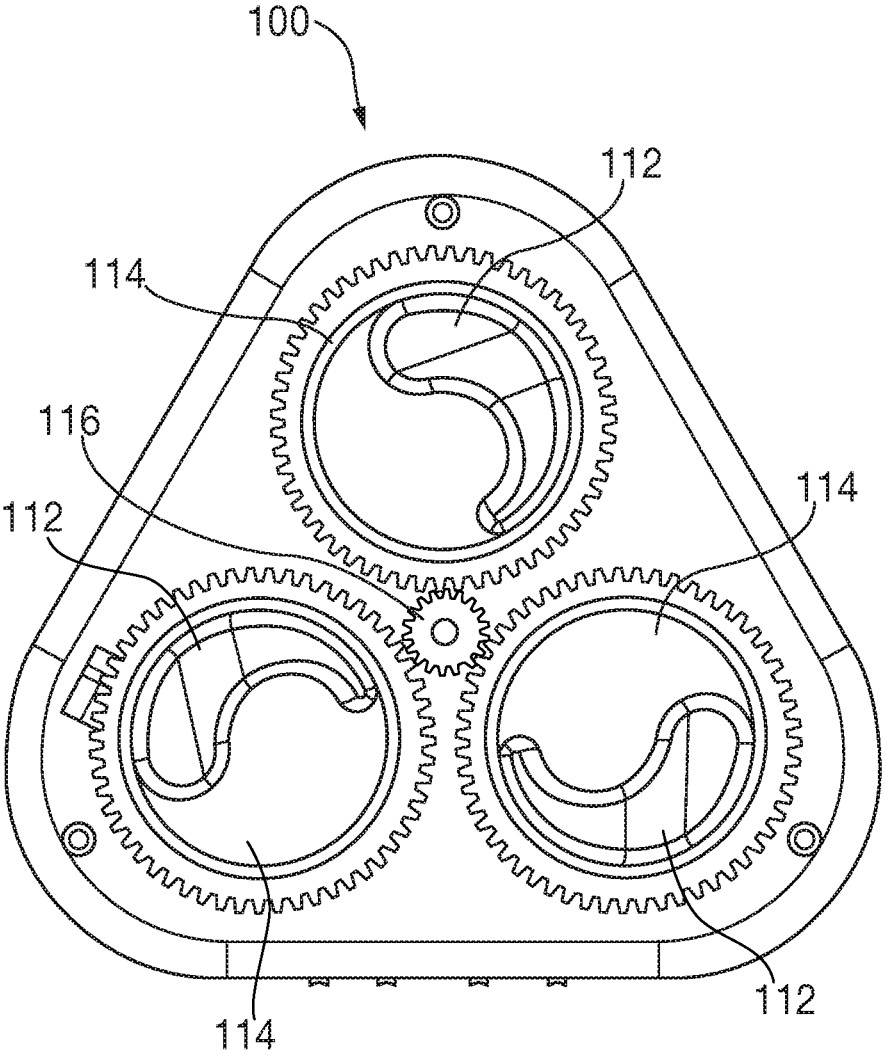
FIG. 5 is a top view of one example of rotating elements of the baby soothing device, according to one embodiment.

FIG. 5 illustrates the rotating elements 108 in further detail and the connection to the bottom panel. In one embodiment, each of the rotating elements 108 comprise a massaging portion 112 attached to a gear base 114. The gear base 114 is disposed on the inside of the housing, with a portion of each gear base 114 visible from each aperture 110 (shown in FIG. 2). The massaging portion 112 of rotating element 108 protrudes from the apertures and away from the housing. Disposed at the center of the rotating elements 108 is a center gear 116, around which the rotating elements 108 revolve. The motor assembly 122 is configured to drive the center gear 116 that in turn drives the rotation of the gear bases 114 mounted around the central gear. Each of the gears rotate around their own centers or the pivots, while the center gear drives the gear bases 114. In other words, the gears rotate around an axis located at the center of each of the rotating elements 108. In one example, the gear base 114 may include a spur gear, however other gear types can also be used, for example, helical gears.

In one example, each of the rotating elements 108 includes a center pivot 136 disposed on the side opposite the side with the massaging elements. The center pivot 136 allows the rotating elements 108 to revolve around the center pivot and provides connection to the bottom panel (shown in FIG. 4). The center gear 116 may include a center shaft that may be connected to the motor assembly.

In the illustrated example, the massaging portion of the rotating element comprises an S-shaped semi-circle, or one half of a yin yang symbol. The massaging portion of the rotating element may be comprised of material that is more pliable than the gear base of the rotating element. The more pliable material may provide a softer massage for the baby and may compress if more pressure is applied to the massaging portion 112, for example, if the baby rotates and lays on top of the rotating elements 108.

In one example, the baby soothing device 100 may include a speaker device 117 configured to play soothing sounds for the baby. The speaker device 117 may be mounted to the top panel 118 and controlled by the control panel. In at least one example, the speaker device may comprise an electronic circuit, which may include a controller, a switch, and a speaker. The power source may provide power to the speaker device 117 and the controller may include memory for storing the music tune for producing via the speaker. In one example, the controller may be integrated as part of the controller of the control panel. In other examples, the controller may be a separate controller. The switch may be accessible to the user through the housing and may be configured to activate the controller which may activate the speaker. In other examples, the switch may be activated in conjunction with the rotating elements 108.

The speaker may include any type of electroacoustic transducer that produces sound in response to an electrical signal input, for example a piezoelectric speaker. The controller may include memory containing a digital form of the music tune, programming instructions to convert the digital form of the music tune to electrical signal to instruct the speaker to produce the music tune. The memory may include one or more music tunes stored in the memory, which may play back to back and continuously as the device is activated. In some examples, the controller may provide for the user to cycle through the music tunes via the use of one or more switches, such as the switches 111, described in reference to FIG. 4. The controller may include a combination of software and hardware.

In at least one example, in addition to the speaker device, the baby soothing device 100 may include a microphone device 115 configured to record sounds and play the recorded sounds for the baby. For example, parents may record their voices that may soothe and calm the baby onto the microphone device 115 and the baby soothing device 100 may play back those sounds via the speaker 117. The microphone device 115 may comprise a microphone, a memory, a controller and a switch. In one example, the controller and the memory may be integrated as part of the controller and the memory of the control panel. In other examples, the controller and the memory may be a separate controller and/or memory. The switch may be accessible to the user through the housing and may be configured to activate the controller which may activate the microphone to record the voice. The voice, once recorded, may be activated via one or more switches such as the switches 111, described in reference to FIG. 4.

FIGS. 6A-6D and FIG. 7 illustrate other embodiments of a baby soothing device 600 and rotating elements 608. FIGS. 6A-6D illustrate one embodiment of the baby soothing device 600 that includes a housing 602 having a top portion 604 and a bottom portion 606, the bottom portion includes apertures 610 though which the rotating elements 608 protrude. The top portion includes the microphone 615 and speaker 617, as described above with reference to FIG. 4.

The top and bottom portions of the housing, shown in FIG. 6A and FIG. 6B, in one example, are substantially equal in size, enclosing a volume configured to house the electrical and mechanical components of the baby soothing device 600. Similar to the baby soothing device 100, the baby soothing deice 600 may include one or more panels on which a motor assembly, a power source, a control panel including a controller and a memory can be disposed, as described above with reference to FIG. 4. The housing 602 is substantially rectangular in shape having four rounded corners. In one example, the sides housing may be beveled or angled as to form sloping edges. Each of the top portion 604 and the bottom portion 606 can include multiple parts or portions making up the shape of the housing.

In the illustrated embodiment, the rotating elements 608 shown in FIG. 6C comprise four rotating elements disposed in a symmetrical, rectangular pattern. As noted above, the rotating elements 608 are configured to protrude through the bottom portion of the housing via the apertures 610. The rotating elements 608, in this example, comprise u-shaped elements which are attached on the points of the u-shape. In operation, the u-shaped rotating elements are configured to be compressible or collapsible into the apertures 610 as a result of sufficient pressure applied to the rotating elements. The compressible rotating elements 608 serve to minimize the amount of pressure applied to the child when massaging the child, and particularly in the event of the child rolling over onto the bottom portion 606 of the housing 602.

Figure 6D:
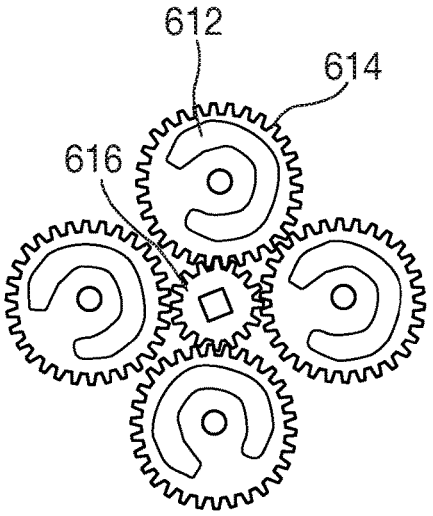
FIG. 6D is a top view of one example of rotating elements of the baby soothing device, according to another embodiment.

In one embodiment, the rotating elements 608 comprise a gear base 614 and a massaging element 612, with the massaging element connected to the gear base 614. FIG. 6D illustrates one example of the gear base 614 to which the massaging elements 612 are attached. The gear bases 614 are disposed around a central gear 616, which is connected to the motor assembly.

Figure 7A:
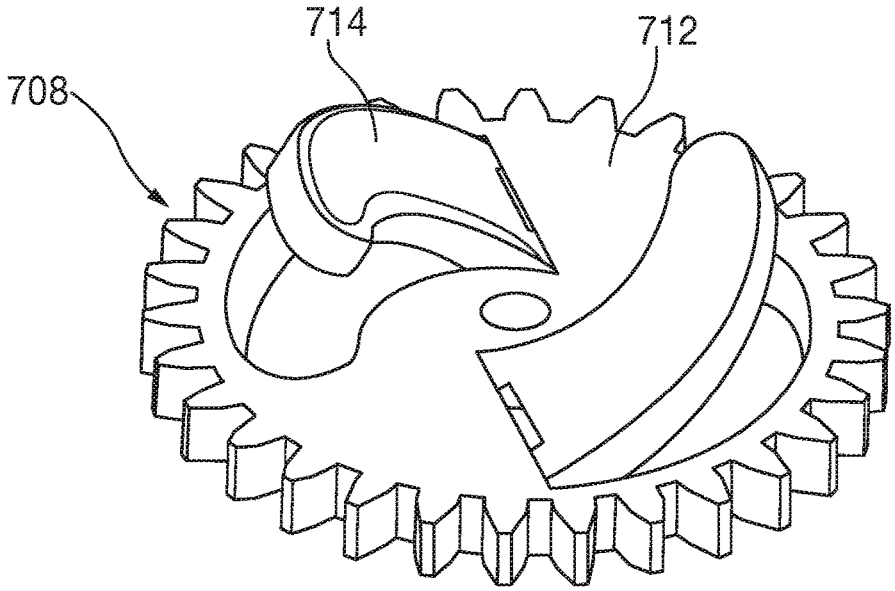
FIG. 7A is a top view of one example of one rotating element of the baby soothing device, according to another embodiment.
Figure 7B:
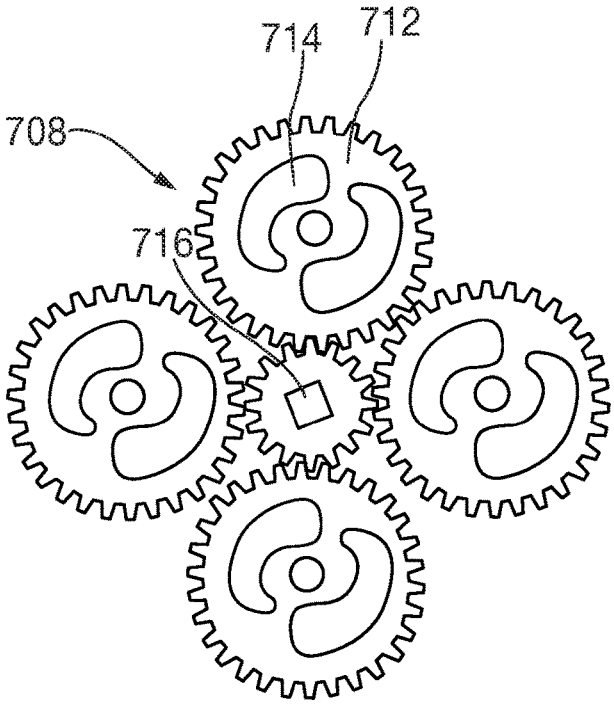
FIG. 7B is a top view of one example of rotating elements of the baby soothing device, according to another embodiment.

FIGS. 7A-7B illustrate another embodiment of rotating elements 708. In this embodiment, the rotating elements comprise four rotating elements disposed in a symmetrical, rectangular pattern shown in FIG. 7B. At least a portion of the rotating elements 708 is configured to protrude through the bottom portion of the housing via apertures, similar to the housing 602 described in reference to FIG. 6B. The rotating elements 708, in this example, comprise curved members or finger-like elements that include a base and a point connected by arc lines as shown in FIG. 7A. In operation, the curved rotating elements are configured to be compressible or collapsible into the apertures as a result of sufficient pressure applied to the rotating elements. The compressible rotating elements 708 serve to minimize the amount of pressure applied to the child when massaging the child, and particularly in the event of the child rolling over onto the housing.

In one embodiment, the rotating elements 708 comprise a gear base 712 and a massaging element 714, with the massaging element connected to the gear base 712. FIG. 7A illustrates one example of the gear base 714 to which the massaging elements 714 are attached. The curved members are disposed opposite each other with the bases and the points on opposing sides of the rotating elements. The base of the curved members comprises a hinge that allows the curved members to fold or collapse into the gear base 712. The curved members may collapse manually or automatically. In other embodiments, the curved members may be fixed in position without collapsing or folding. The gear bases 712 are disposed around a central gear 716, which is connected to the motor assembly.

Figure 8:
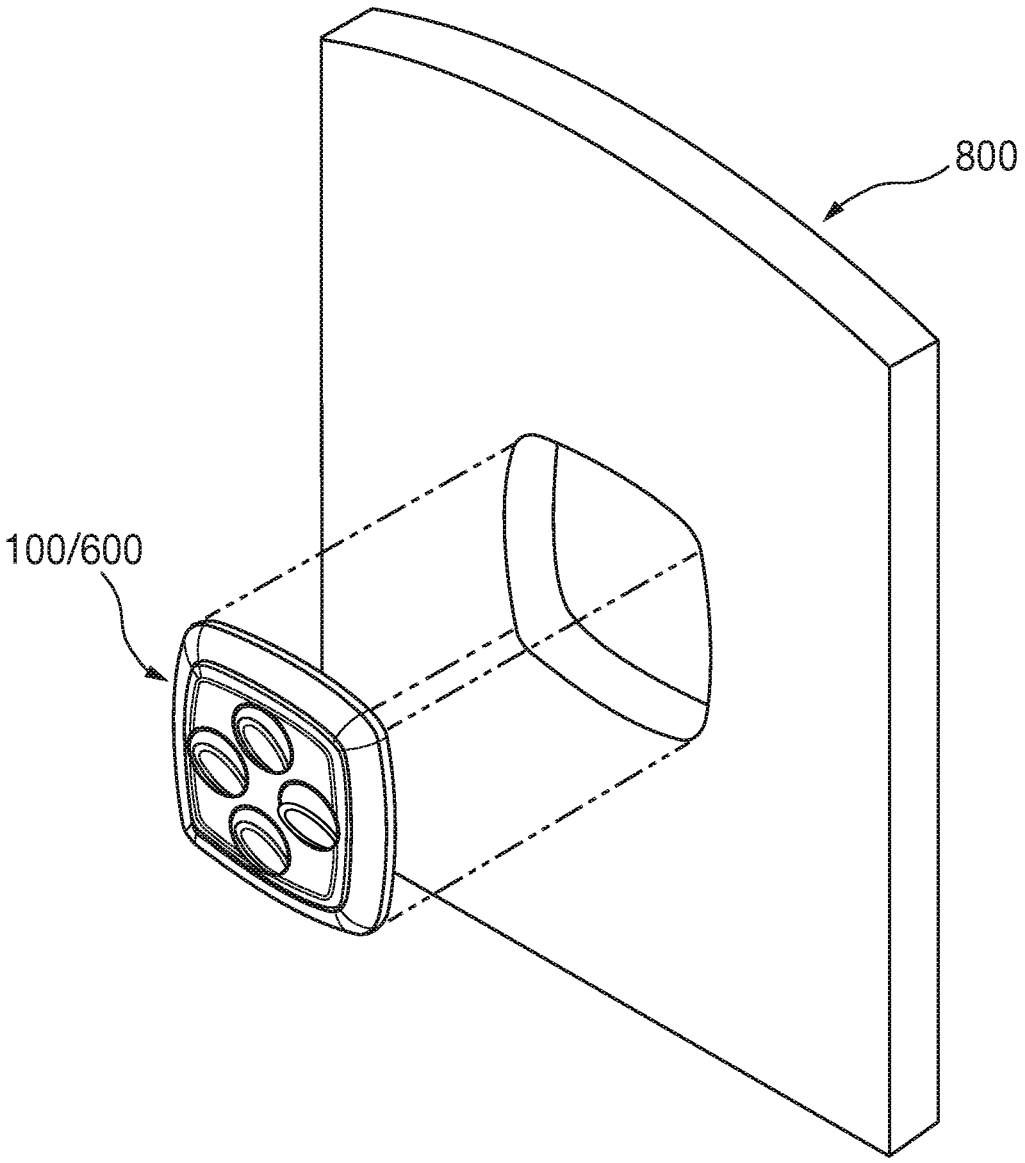
FIG. 8 is an isometric view of one example of an insert for a baby soothing device, according to one embodiment.

In one embodiment, the baby soothing device can be embedded in an insert with the top surface of the device exposed in the insert. FIG. 8 illustrates one embodiment of a baby soothing device embedded in an insert 800. The baby soothing device may be the baby soothing device 100 as described in reference to FIGS. 1-5, or the baby soothing device 600 as described in reference to FIG. 6A-6D. In one example, the insert 800 can comprise substantially flat sides that can be flush with the top and bottom portions of the housing of the baby soothing device. The rotating elements can be configured to protrude from the insert. In one example, the insert can be made of a soft, pliable material, such as foam, or gel, polyester stuffing, or other similar materials.

The insert can be placed within a blanket, such as for example a child swaddling blanket or sleep sack. The child can be wrapped inside the blanket with the device to provide continuous massage to the baby. The insert can also be integrated into various baby carriers. The insert provides an added level of comfort to the child, as most of the contact with the child is through the soft form rather than hard plastic of the housing of the baby soothing device. In addition, the insert 800 provides portability for the device as the insert can be taken out from one blanket and moved to another. Similarly, the insert can be placed in almost any child carrying device, such as baby car seat, stroller, crib, bassinet, or bjorn.

In one example, an insert may include a cut out or an opening configured to fit the baby soothing device. The opening may be sized and shaped to fit the size and shape of the baby soothing device. For example, as shown in FIG. 8, the opening is rectangular to fit the shape of the rectangular housing 602 of the baby soothing device 600. However, in other examples, the insert 800 may include a triangular opening to fit the triangular shape of housing 102 of the baby soothing device 100. It is appreciated that the opening can be shaped to fit any shape of the baby soothing device including circular, or oval, given the benefits of this disclosure.

Figure 9A:
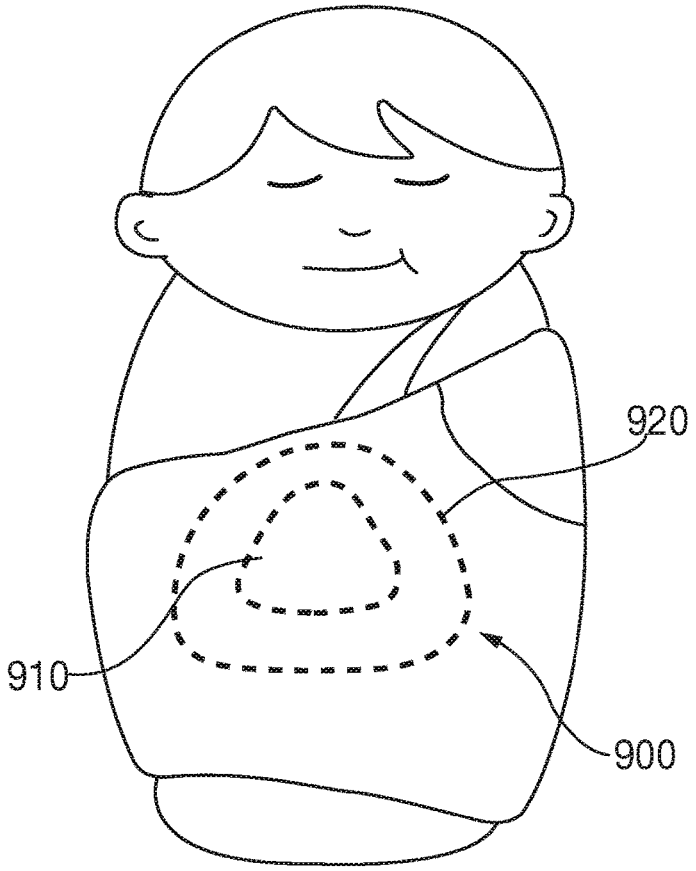
FIG. 9A is a schematic of an apparel component which may be used in conjunction with the baby soothing device in accordance with one or more embodiments.

In accordance with one or more embodiments, the device may be coupled with an apparel component configured to receive the device. In some non-limiting embodiments, the apparel component may include a pocket to receive the device. FIG. 9A illustrates apparel component 900 which is configured to receive device 910 in pocket 920. The pocket may be strategically positioned, such that the device will be in contact with a baby's stomach or back during operation. The pocket may be detachable such as with hook and loop fasteners. In at least one embodiment, the pocket may be moveable and attachable at various positions on the apparel such as depending on the sleeping position of the baby. In embodiments where the pocket is removable, it may be used in conjunction with various commercially available garments interchangeably. In other embodiments, the pocket may be fixed in place and generally integrated into the apparel component such that the device just needs to be inserted. In some embodiments, the pocket may be cushioned so that the device can be directly inserted. The pocket may therefore serve as a protective insert described above. In other embodiments, the pocket may be sized so that it can receive a device housed in an insert as described above. In some embodiments, the apparel component may be a swaddling blanket or sleep sack. A kit may generally include a baby soothing device and an apparel component.

Figure 9B:
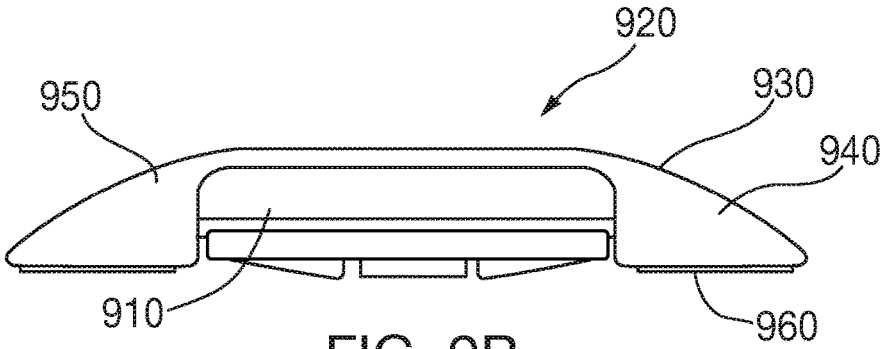
FIG. 9B is a schematic of a pocket of an apparel component in accordance with one or more embodiments.

The pocket, whether moveable or stationary, may generally be configured to receive the device. In some non-limiting embodiments, the pocket may define an enclosure to house the device. In some specific embodiments, the pocket may be padded. FIG. 9B illustrates pocket 920 which includes a fabric outer covering 930 and a flexible foam inner shape 940 to cushion the pocket. The fabric outer covering 930 may be thin such that one or more buttons or switches may be activated through it. The inner shape 940 may define a recess 950 in the pocket to hold the device 910. The device 910 may be placed in the recess 950 and held in place by the fit and optionally with a restraint such as an elastic band (not shown). The pocket may be connected to an apparel component at attachment portion 960.

Figure 10A:
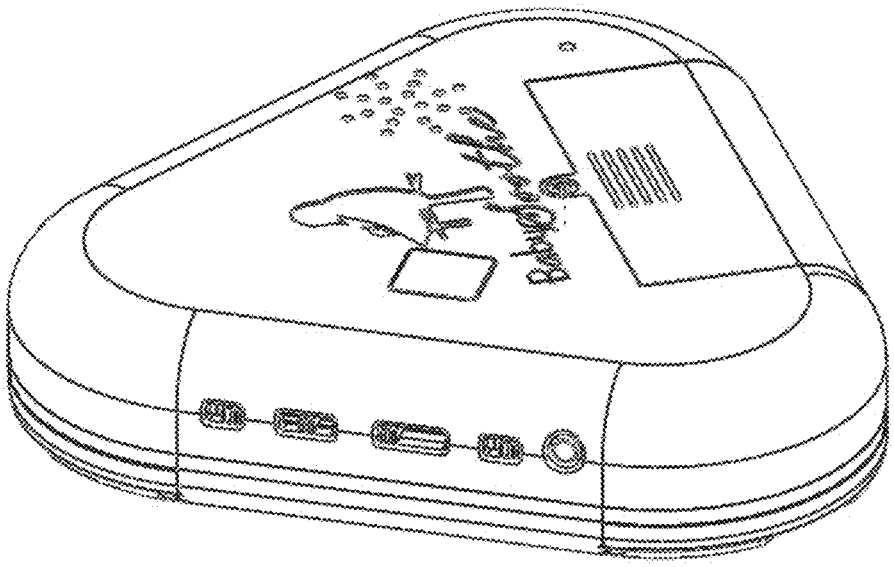
FIGS. 10A and 10B present top views of a baby soothing device having clips retracted and extended in closed and open positions, respectively, in accordance with one or more embodiments.
Figure 10B:
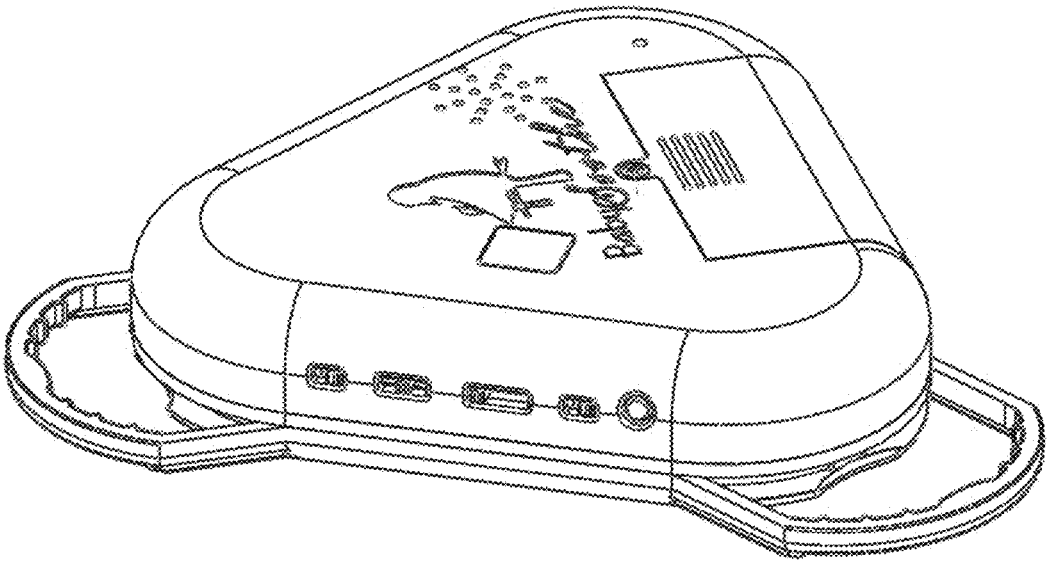
Figure 11A:
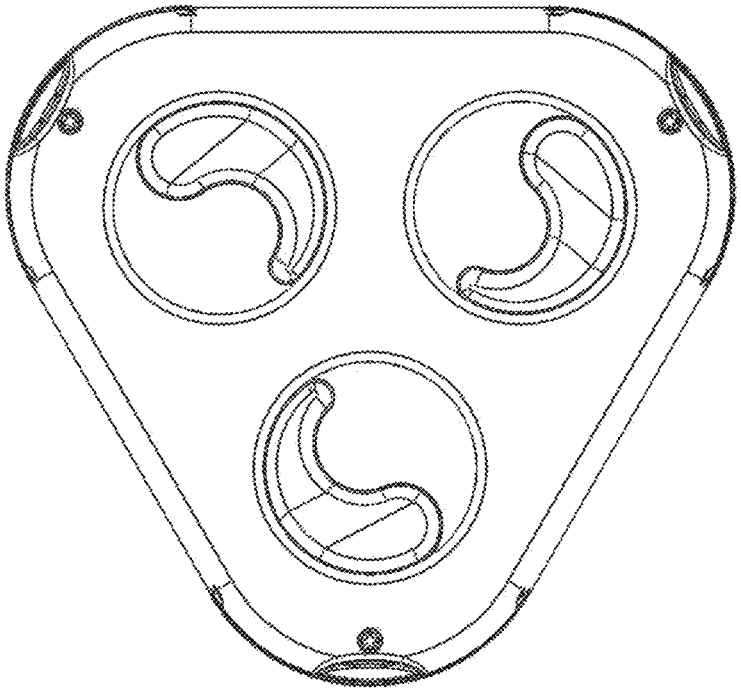
FIGS. 11A and 11B present bottom views areas of a baby soothing device having clips retracted and extended in closed and open positions, respectively, in accordance with one or more embodiments.
Figure 11B:
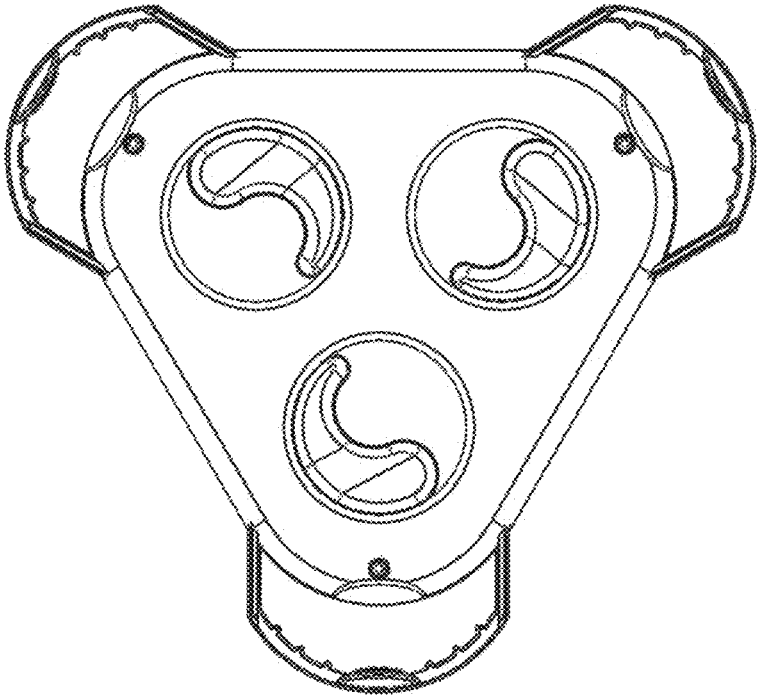
Figure 12:
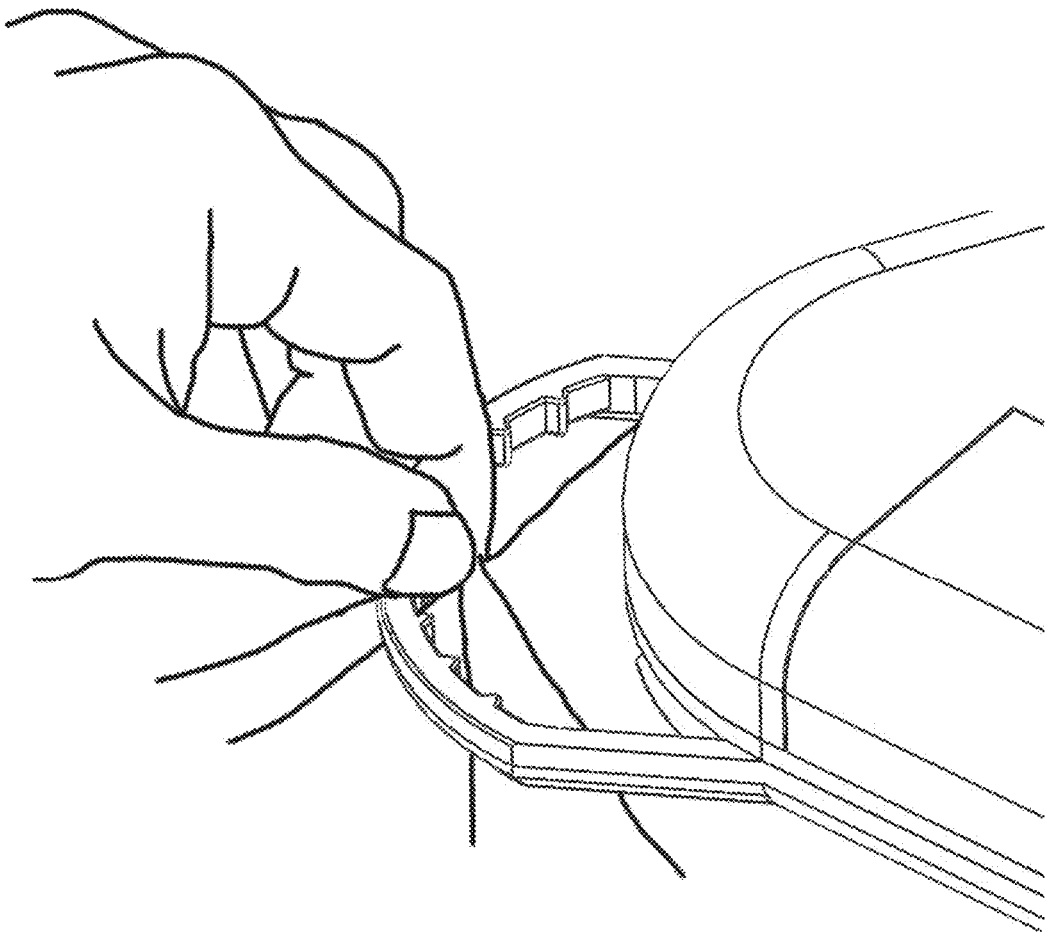
FIG. 12 presents a detailed view of a clip in operation in accordance with one or more embodiments.

In accordance with one or more non-limiting embodiments, the device may include at least one clip to facilitate placement. In some embodiments, a clip may be positioned at one or more corners of the device. Some embodiments include a clip at each of three corners. The clips may generally be retractable. The clips may be independently operated. The device may be configured to receive and house the clips. In some embodiments, the device may include click-stop detents to facilitate retraction and extension of the clips for internal storage and subsequent deployment. The clips may facilitate attachment to any external material, such as fabric. In some embodiments, the clip may attach to clothing such a sleepwear, or a blanket or any other desired surface or material that can be trapped by the clip. In operation, the device may be placed on a baby at a desired position, such as the stomach, back or other location where massaging action is desired. One or more clips may then be extended from the device up to their fully extended position. Fabric may then be pulled up through the clip to trap at least a portion thereof. The clip may then be pushed back into the casing of the device as much as possible so as to positively hold the entrapped material. The clips may have detents such that there are various stop positions to ensure a positive, firm and secure holding action between the clip and entrapped material. One or more clips, such as two or three may be used in conjunction to keep the device in place. The clips can then be easily released when desired by either opening the clips or by pulling the device from the entrapped material. FIGS. 10A-10B (top) and 11A-11B (bottom) illustrate the clips (retracted and extended) in accordance with one or more non-limiting embodiments described herein. FIG. 12 presents a schematic of a clip in operation based on at least some embodiments.

In accordance with some non-limiting embodiments, the device may be configured to turn on upon initiation of a baby crying and/or turn off upon quieting of the baby. In other embodiments, the device may be configured to turn off upon detection of moisture from any source for safety. The device may also include an auto shut-off safety feature if the baby rolls on its back or assumes another undesirable position. One or more sensors may facilitate such modes of operation.

In accordance with one or more embodiments, the size of the device may depend on its intended use and the size of its components, including the batteries, motor, gears and electronic circuit. A possible range may be from about 3 inches in width to about 5 inches, with a smaller size potentially being more favorable for the comfort of the baby. The massage gears may range in terms of degree of protrusion which may impact what is felt by the baby. In some non-limiting embodiments, protrusion of the massage fingers might range from about 0.25 inches to about 0.5 inches. Contributing factors may also include the weight of the device and its contact on the surface of the blanket or fabric covering the baby. This may generally be related to the pressure that would be exerted by the device on the baby. The device may be made of any child safe material. In some non-limiting embodiments, parts may be injection molded of a highly durable ABS type of plastic. Rotating components may be made of a rigid Nylon material for durability and best wear features.

In accordance with one or more non-limiting embodiments, there may be an on/off switch to apply power to the unit. A second switch, such as a three position switch, may provide an option of selectable timing that the unit will run before automatically turning off. Some non-limiting possibilities may include: position 1 involves 5 minutes of operation, position 2 involves 10 minutes of operation, and position 3 involves 20 minutes of operation. The timing options may be preset or programmable. A third switch may allow the user to change the speaker output from off, to a choice of a heartbeat sound, or a choice of a user recorded voice, or a prerecorded musical song. A forth switch may turn the included microphone on or off. The microphone may serve various purposes, including to record the user's voice for playback mode, and to detect the crying of the baby to restart the motion after the above timing cycle had stopped. Turning off the microphone could be useful in a noisy environment that would continue to trigger the device that was not a response of the baby. A pushbutton switch may be used by the user when recording their voice for the voice playback feature. Additionally, on the top of the unit a pushbutton may serve as a basic "start" button to start the cycle of the unit. In accordance with one or more embodiments, a light feature such as an LED indicator may be incorporated. It may light up when the unit is operating to signal operation to the user. Lighting may provide additional soothing or other indication to the operator.

In operation, a user may set the time switch for a desired length of massage. The speaker may be set to a desired setting. The microphone may be switched on or off. The power switch may then be turned on. If the user desires to record their voice, they may set the speaker switch to "voice" and press the record button while speaking or singing into the microphone for the duration. The activated device may be brought into contact with the baby, such as by inserting it in an apparel pocket to hold it in place, with the rotating massager elements facing the baby's body. The Start switch on the top of the unit may be pressed to begin the massage while playing the chosen speaker output. When the unit stops massaging, it may automatically be placed in a "listening" mode, via the microphone that will start the massage cycle again if it detects the baby crying. At any time, during a stopped condition, the user can press the Start switch again for another cycle of operation.

Having now described some illustrative aspects of the invention, it should be apparent to those skilled in the art that the foregoing is merely illustrative and not limiting, having been presented by way of example only. Numerous modifications and other illustrative embodiments are within the scope of one of ordinary skill in the art and are contemplated as falling within the scope of the invention. In particular, although many of the examples presented herein involve specific combinations of apparatus components or elements, it should be understood that those elements may be combined in other ways to accomplish the same objectives. Aspects, elements and features discussed only in connection with one embodiment are not intended to be excluded from a similar role in other embodiments.

What is claimed is:

1. A device for soothing a baby, comprising:

a triangular housing having a top portion having an opening that receives a start button for an activation switch, a bottom portion having a plurality of apertures formed therein, the apertures including a first aperture, a second aperture, and a third aperture, and a panel disposed between the top portion and the bottom portion, the activation switch disposed on the panel, and the start button disposed on the activation switch;

a plurality of rotating elements movably disposed within the triangular housing, each of the rotating elements including a gear portion and a massaging element attached to and extending outwardly from the gear portion, the massaging element protruding through one of the apertures of the bottom portion of the triangular housing, and the rotating elements including a first rotating element disposed within the first aperture of the triangular housing, a second rotating element disposed within the second aperture of the triangular housing, and a third rotating element disposed within the third aperture of the triangular housing, each of the first rotating element, the second rotating element, and the third rotating element oriented co-planar with and disposed around a central gear, the central gear directly contacting the gear portion of the first rotating element, the gear portion of the second rotating element, and the gear portion of third rotating element; and a motor disposed on the panel, the motor configured to rotate the central gear, the central gear configured to rotate the gear portion of the first rotating element, the gear portion of the second rotating element, and the gear portion of the third rotating element, wherein the massaging element of each of the plurality of rotating elements has a base and a point connected by arc lines and has a shape of one half of a yin yang symbol, and only the shape of one half of the yin yang symbol protrudes through one of the apertures and is configured to emulate a massage motion made by a human finger upon being rotated.

2. The device of claim 1, wherein the device is embedded in an insert having an opening configured to receive the device and the insert is configured to be placed within a blanket.

3. The device of claim 1, further comprising a microphone.

4. The device of claim 1, further comprising at least one retractable clip.

5. The device of claim 1, wherein rotating movement of the massaging elements is substantially circular.

6. A system for soothing a baby, comprising:

a device for soothing a baby, including a triangular housing having a top portion having an opening that receives a start button for an activation switch, a bottom portion having a plurality of apertures formed therein, the apertures including a first aperture, a second aperture, and a third aperture, and a panel disposed between the top portion and the bottom portion, the activation switch disposed on the panel, and the start button disposed on the activation switch, a plurality of rotating elements movably disposed within the triangular housing, each of the rotating elements including a gear portion and a massaging element attached to and extending outwardly from the gear portion, the massaging element protruding through one of the apertures of the bottom portion of the triangular housing, and the rotating elements including a first rotating element disposed within the first aperture of the triangular housing, a second rotating element disposed within the second aperture of the triangular housing, and a third rotating element disposed within the third aperture of the triangular housing, each of the first rotating element, the second rotating element, and the third rotating element oriented co-planar with and disposed around a central gear, the central gear directly contacting the gear portion of the first rotating element, the gear portion of the second rotating element, and the gear portion of third rotating element, and a motor disposed on the panel, the motor configured to rotate the central gear, the central gear configured to rotate the gear portion of the first rotating element, the gear portion of the second rotating element, and the gear portion of the third rotating element, wherein the massaging element of each of the plurality of rotating elements has a base and a point connected by arc lines and has a shape of one half of a yin yang symbol, and only the shape of one half of the yin yang symbol protrudes through one of the apertures and is configured to emulate a massage motion made by a human finger upon being rotated; and an apparel component configured to receive the device.

7. The system of claim 6, wherein the apparel component includes a padded pocket configured to receive the device.

8. The system of claim 6, wherein the apparel component comprises a swaddle blanket or sleep sack.

9. The system of claim 6, wherein the device comprises at least one retractable clip.

* * * * *